US005459561A

United States Patent [19]

Ingram

[11] Patent Number: 5,459,561

[45] Date of Patent: Oct. 17, 1995

[54] METHOD AND APPARATUS FOR FUSING TONER INTO A PRINT MEDIUM

[75] Inventor: Glenn B. Ingram, Boise, Id.

[73] Assignee: Hewlett-Packard Company, Palo Alto, Calif.

[21] Appl. No.: 418,924

[22] Filed: Apr. 11, 1995

Related U.S. Application Data

[63] Continuation of Ser. No. 132,598, Oct. 6, 1993, abandoned.

[51] Int. Cl.[6] ..... G03G 15/20

[52] U.S. Cl. ..... 355/286; 347/156

[58] Field of Search ..... 355/286; 347/156; 359/204, 217, 218, 219; 372/24

[56] References Cited

U.S. PATENT DOCUMENTS 4,578,688 3/1986 Okuno ..... 346/157

FOREIGN PATENT DOCUMENTS 57-204573 12/1982 Japan ..... 355/286

4-51267 2/1992 Japan ..... 355/286

*Primary Examiner*—Joan H. Pendegrass

*Attorney, Agent, or Firm*—E. F. Oberheim

[57] ABSTRACT

A method and apparatus in electrophotographic printing for fusing a toner image onto or into a print medium. A high energy laser beam is projected onto a toner image on a print medium for softening or fusing the toner. Pressure is then applied to the toner against the print medium to permanently fix the toner image onto or into the print medium as a printed image. The high energy laser beam for softening or fusing the toner is synchronized in scan frequency, either at the scan frequency or a whole multiple of the scan frequency, with the low energy image modulated laser beam which scans to photoconductive drum, being reflected from selected facets of a common scanner, or from a selected facet of each of a pair of relatively angularly displaced interconnected scanners.

2 Claims, 4 Drawing Sheets

METHOD AND APPARATUS FOR FUSING TONER INTO A PRINT MEDIUM

CROSS REFERENCE TO RELATED APPLICATION

This is a continuation of application Ser. No. 08/132,598, filed on Sep. 06, 1993, now abandoned.

FIELD OF THE INVENTION

This invention relates generally to electrophotographic or laser printers and particularly to the use of a laser beam in such printers in the mechanism and process for securing or fusing a toner onto or into a print medium.

BACKGROUND OF THE INVENTION

In the field of laser or electrophotographic printing, a latent image developed on a charged photoconductive drum or belt is exposed to toner to form a toner image. Then the toner image is transferred from the drum or belt to a print medium, such as paper. After, or concurrent with, the toner image transfer, the process involves the application of heat and pressure to the toner on the print medium, usually by a heated pressure roller backed by an idler roller. This process of heating the toner to secure it to the print medium is called fusing. Thus the toner is said to be normally fused onto or into the print medium, using one or more heated fuser pressure rollers. One such process is disclosed in U.S. application Ser. No. 07/758,011, now allowed, of Chris A. Storlie et al, filed Sep. 12, 1991, assigned to the present assignee and incorporated herein by reference. While the approach of Storlie et al provides improvement over prior electrophotographic printers and produces high quality text or graphic images, the search continues for ways to reduce energy requirements and start-up time and to increase the life expectancy of the toner transfer mechanism in such printers.

SUMMARY OF THE INVENTION

In accordance with the present invention, there has been discovered and developed a completely novel and alternative approach to the above method of fusing and pressing the developed image against the print medium. This approach utilizes a high energy laser beam as the fuser to heat the developed toner image on the print medium. The high energy laser beam is synchronized with a low energy laser beam which is used to developed the latent image on the photoconductive drum or photoconductive belt. Then, a roller is used to apply an added measure of heat, if needed to sustain the fussing process, and some pressure to the laser heated toner to thereby permanently fix the image in place on the print medium.

Accordingly, an object of this invention is to provide an electrophotographic printer in which toner fuser warm-up time is substantially eliminated.

Another object of this invention is to provide an efficient method requiring less energy than existing methods and systems, to quickly raise the temperature of the toner material to its transition or fusion temperature.

Another object of this invention is to provide a new and improved method and apparatus which precisely controls and applies the thermal energy which is required to raise the toner to its transition or fusion temperature for the purpose of improving toner adhesion to the print medium.

A specific object of this invention is to provide an electrophotographic printer in which the life expectancy of the fuser function is increased and is substantially the same as that of the printer.

Another specific object of this invention is to provide an electrophotographic printer in which the thermal mass of the fuser mechanism is substantially eliminated, reducing the fire hazard.

In accordance with the best mode for practicing this invention, there is provided a toner fuser process and system employing a high energy laser source, a fixed mirror, and a scanner mirror, synchronized with the low energy laser beam scanner mirror, as by attachment thereto, positioned between the high energy laser source and the fixed mirror, for synchronizing the high energy laser beam with the low energy, image modulated laser beam, the latter of which is used for writing text or graphics onto a photoconductive drum. The fixed mirror in the high energy laser path reflects the high energy laser beam onto the toner images deposited on the print medium. The high energy laser beam heats the toner to a temperature above its transition or fusion temperature which softens the toner. Then, a pressure roller applies pressure to the toner against the print media, resulting in adhesion of the toner to the paper or other print media. The temperature of the surface of this roller is preferably about room temperature. If needed a small amount of thermal energy may be applied to the pressure roller, thus avoiding any significant cooling of the toner as it comes in contact with the roller. The temperature requirement of the pressure roller is significantly less than that required in prior art pressure rollers, since there is no longer a requirement of the roller to elevate the toner temperature to the fusing or transition temperature. Additionally cooling at the surface of the lo toner as pressure is applied sets the toner at the surface of the print media. This permits immediate handling of the print without smudging.

The above brief summary of the invention, together with its various advantages, objects, and novel features, will be apparent in detail from the following description of the accompanying drawing.

BRIEF DESCRIPTION OF THE DRAWINGS

Three figure groups, FIGS. 1–3, FIGS. 4–6 and FIGS. 7–9, include schematic illustrations in plan and elevation of three different embodiments of this invention.

DETAILED DESCRIPTION OF THE INVENTION

Figure 1:
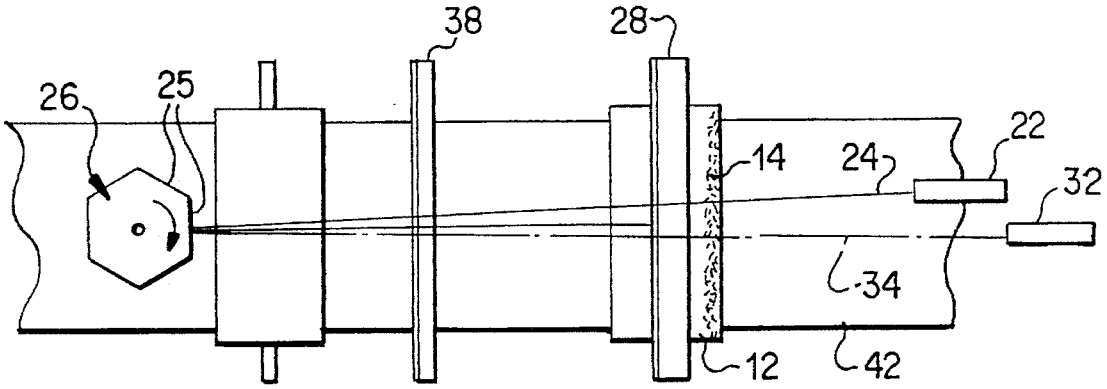
Figure 2:
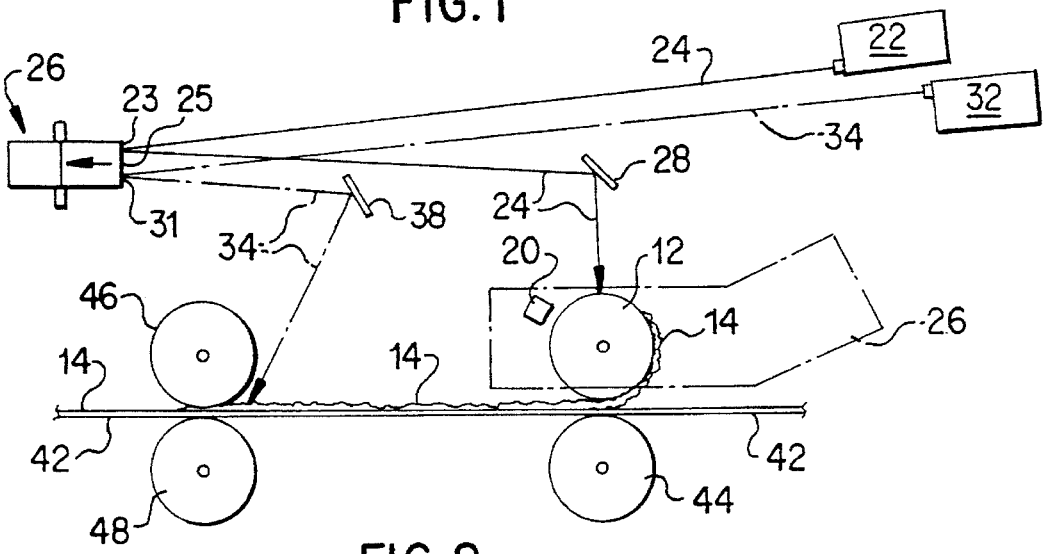
Figure 3:
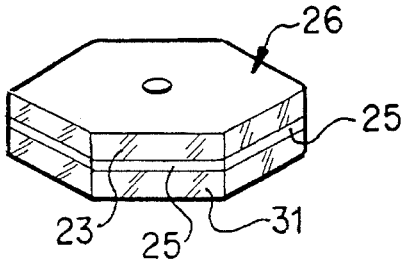

Referring now to FIGS. 1, 2 and 3 there is shown a first embodiment of a laser printer designated generally as 10 and having a photoconductive drum 12 therein which receives toner 14 from an adjacent source of toner material 16. A conventional charge corotron 20 charges the surface of the photoconductive drum 12 to a predetermined potential sufficient to attract the charged toner particles 14 to the surface of the photoconductive drum 12 from an adjacent toner source 16, according to conventional practice.

A low energy laser source and laser beam modulator 22 is positioned to project an image modulated, monochromatic light beam 24 onto a mirror 23, see FIG. 3, of a facet 25 of a hexagonal laser scanner 26 which, when rotating, reflects and scans the image modulated laser beam 24, reflected from the mirror 23 on each facet 25 of the laser scanner 26, across the surface of a fixed imaging mirror 28 in the path of the image modulated laser beam 24. The image modulated laser light beam 24 is reflected by the fixed mirror 28 onto the surface of the photoconductive drum 12 where, in repeated scanning passes, a latent image is developed in the charged surface layer of the photoconductive drum to which charged particles of toner from a toner source 16, of selected color, are attached, as is well known.

A high energy laser source 32 projects its light beam 34 to a mirror 31, see FIG. 3, on each facet 25 of the laser scanner 26 from which it is scanned across a second fixed mirror 38. The high energy laser light beam 34, reflected from the second fixed mirror 38, scans the toner 14 on the surface of a print medium 42, as shown.

The print medium 42 advances between a transfer roller 44 and the photoconductive drum 12 where the toner image is transferred to the print medium 42. Then the print medium 42 passes between a pair of rollers 46 and 48 having a surface speed matching the speed of the print medium 42. In the area just to the right of the two rollers 46 and 48, the high energy laser beam 34 scans the toner synchronously with the modulated laser beam 24. This softens the toner. As the print medium 42 with the softened toner passes between the surfaces of the rolls 46 and 48, the roll pressure which is applied to the fused or softened toner, presses the toner against the print medium to aid in fusing or fixing the toner image to the print medium 42. The upper roll 46 in contact with the toner cools the surface of the toner, in brief contact therewith as the print media advances, without cooling the toner fusing junction at the print medium. Thus, the toner is fixed or fused to the print medium and the surface of the toner is set sufficiently to permit immediate handling without smudging. Heating of the upper roll 46 in some small amount may be employed to obtain and maintain an ideal roll temperature. Since the modulated laser beam 24 and the high energy laser beam 34 are projected onto a common scanner 26, the beams are synchronized scanning in frequency.

The principles of this invention are practiced in other configurations of the electrophotographic printer, particularly with respect to arrangements for scanning the two laser beams.

Figure 4:
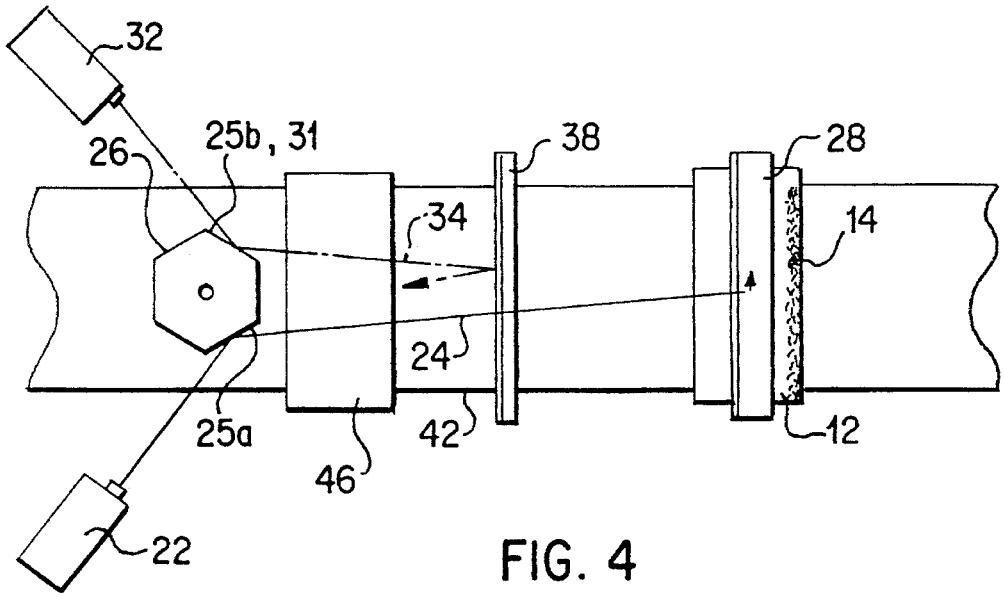
Figure 5:
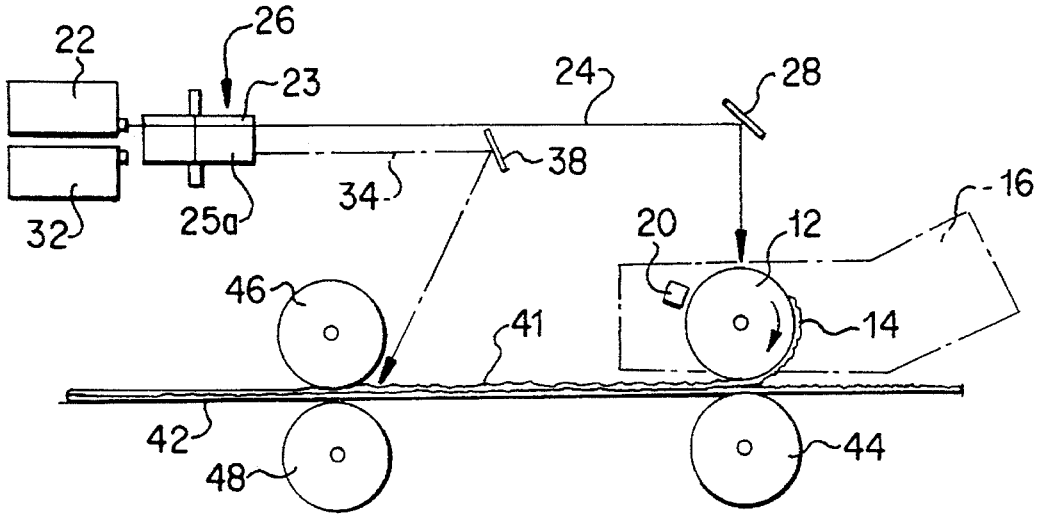
Figure 6:
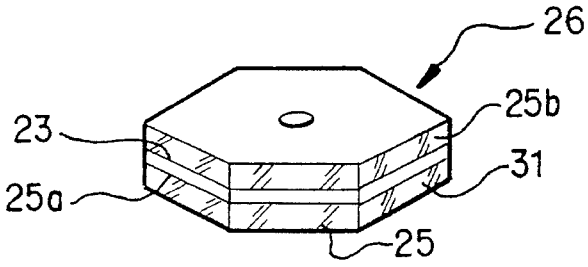

As seen in FIGS. 4, 5 and 6, referring particularly to FIG. 6, the image modulated laser beam 24 is reflected by the mirror 23 on a facet 25*a* of the scanner 26 and the high energy laser beam, is reflected by the mirror 31 which is disposed on a different facet 25*b* of the scanner 26. These facets 25*a* and 25*b* are separated by the facet 25, but being on the scanner 26, move in a fixed angular relationship as the scanner 26 rotates and thereby scan the respective laser beams 24, 34 in synchronism. The laser beam sources 22 and 32 are now relocated to project the laser beams 24 and 34 at angles of incidence against the respective mirrors 23 and 31 so that each laser beam is scanned appropriately with respect to the photoconductive drum 12 and the toner 14 on the print media, to span the width of the print media.

Figure 7:
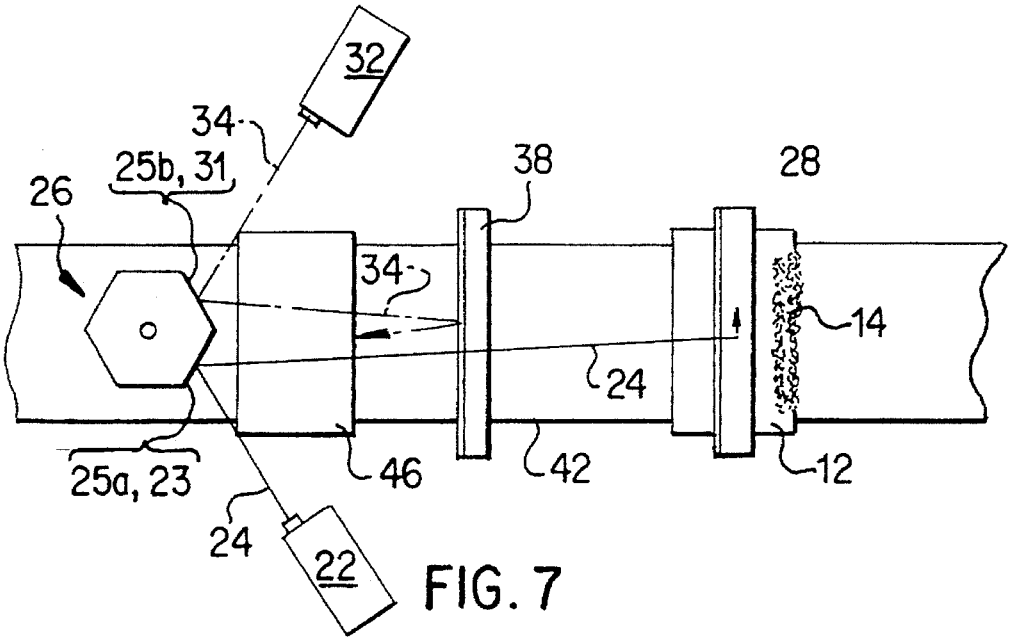
Figure 8:
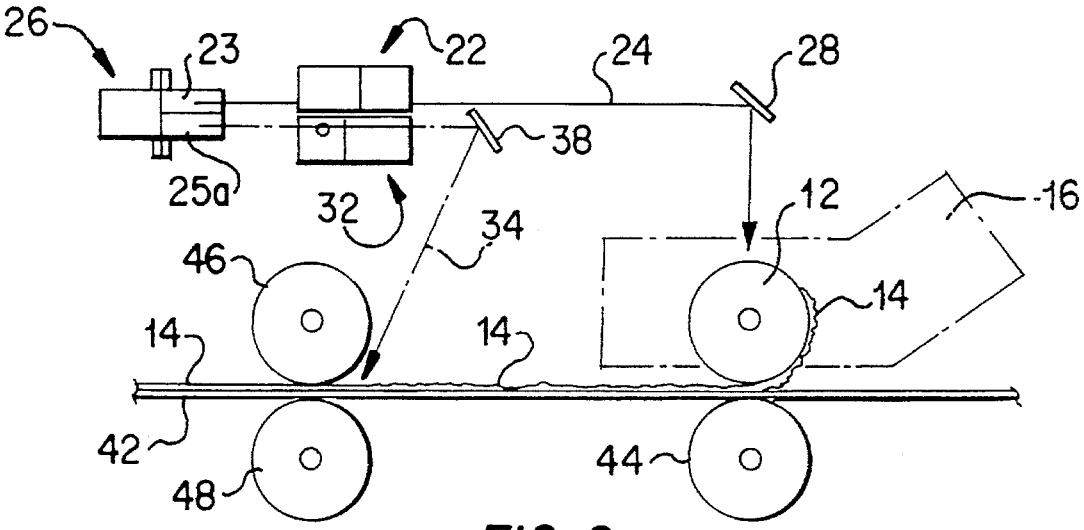
Figure 9:
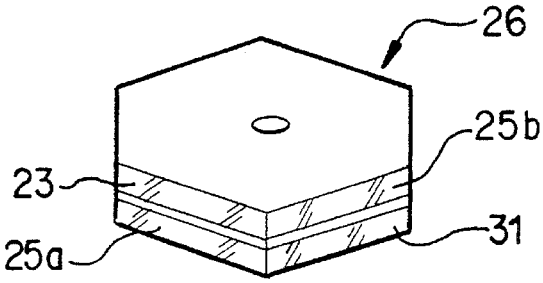

As seen in FIGS. 7, 8 and 9, the respective scanner mirrors 23 and 31 which reflect the low energy and high energy laser beams are on adjacent facets 25*a* and 25*b* of the scanner 26, which requires relocating the laser sources 22 and 32 to achieve the required scanning range.

Figure 10:
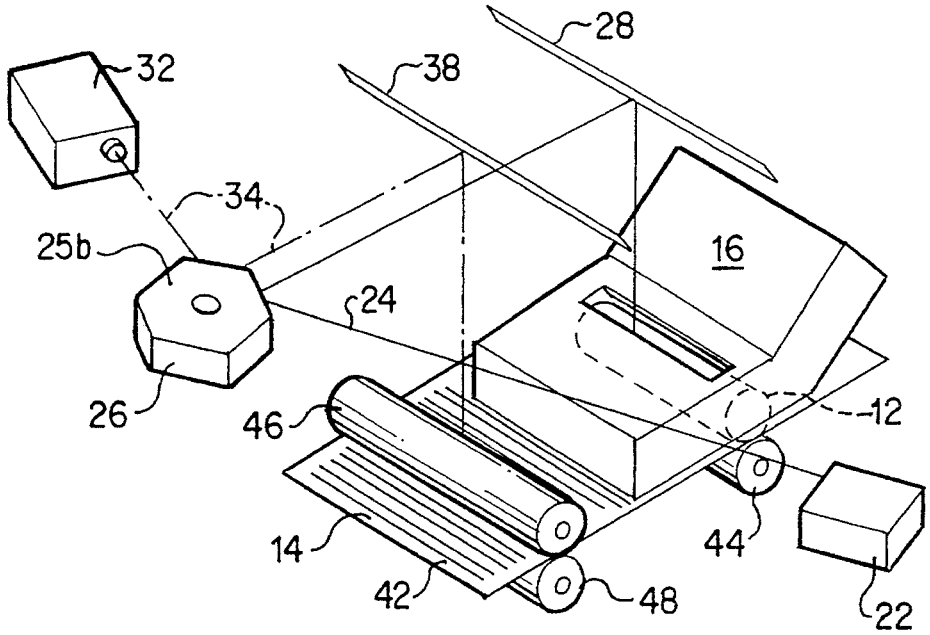
FIG. 10 is an isometric view of the embodiment of the invention of FIGS. 7–9.
Figure 11:
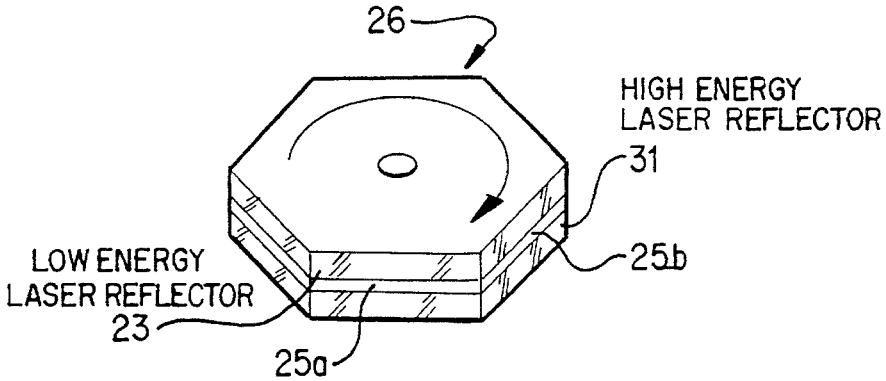
FIGS. 11 isometrically depicts the scanner mirror embodied in FIG. 10.

FIGS. 10 and 11 provide an isometric view of the embodiment of the invention of FIGS. 7, 8 and 9 to provide in FIG. 10 a pictorial concept of the printer. Similarly in FIG. 11 an isometric representation of the scanner 26 provide a clear picture of the adjacent facets 25*a* and 25*b* together with the respective mirrors 23 and 31.

Figure 12:
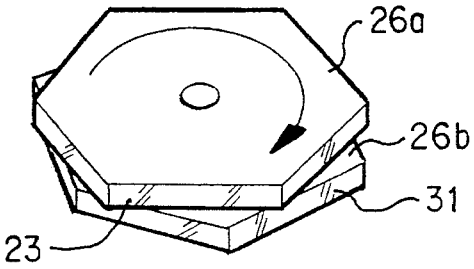
FIG. 12 is an isometric view of a composite scanner.

Although a single scanner 26 is preferred in practicing this invention, the invention may be practiced employing two scanners mechanically integrated to rotate together, one for the image modulated laser beam 24 and one for the high energy laser beam 34, as seen in FIG. 12. In the interest of simplicity only the dual composite scanner assembly 26, comprising scanner sections 26*a*, 26*b*, is shown. Here, it will be observed, is a structure which permits relatively offsetting the facets 25*a*, 25*b* to permit relative positioning of the laser sources 22 and 32 other than in the three relative positions discussed above. The separate scanners are mechanically joined in a selected angular relationship to rotate together and thus to sweep the laser beams 24 and 34 in synchronism. While coaxially connecting the scanners, as shown, offers the less complex mechanical connection, the scanners may be located to rotate about separate axes, with appropriate mechanical connection to achieve synchronism in scanning or scanning at frequencies where one frequency, say the scanning frequency of the high energy laser beam is a whole multiple of the scanning frequency of the image modulated laser beam. In the coaxial scanner, higher frequency scanning of the high energy laser beam may be accomplished, for example, by doubling the member of facets.

These several configurations provide differing opportunities for packaging the printer parts to achieve package sizes and shapes for differing assembly or installation requirements or market appeal, while employing functional laser beam incidence angles at the respective facets 23, 31 on the scanner 26.

Various additional modifications may be made in and to the above described preferred embodiments without departing from the spirit and scope of this invention. Accordingly, the invention may be practiced other than as specifically described.

What is claimed is:

1. Electrophotographic printing apparatus for securing a toner image to a print medium, comprising:

a. means for moving said print medium;

b. means for producing an image modulated laser beam;

c. a movable photoconductive member;

d. means for scanning said image modulated laser beam over said photoconductive member while said photoconductive member is moving to develop a latent electrophotographic image;

e. means for applying charged toner particles to said latent electrophotographic image on said photoconductive member while said photoconductive member is moving, for developing a toner image;

f. means for transferring said toner image from said photoconductive member to said print medium while said print medium is moving;

g. a high energy laser source for producing a high energy laser beam;

h. a rotatable faceted scanning mirror disposed in the path of said image modulated laser beam and in the path of said high energy laser beam, said image modulated laser beam and said high energy laser beam, reflected, respectively, from adjacent facets of said rotatable faceted scanning mirror for scanning said high energy laser beam synchronously with scanning of said image;

i. a fixed mirror disposed in the path of said high energy laser beam between said faceted scanning mirrors and said print medium for projecting said high energy laser beam onto said toner image on said print medium while said print medium is moving, for producing softened toner, and j. a pair of opposed rollers for receiving said print medium therebetween for applying pressure to said softened toner against said print medium.

2. Electrophotographic printing apparatus for securing a toner image to a print medium, comprising:

a. means for moving said print medium;

b. means for producing an image modulated laser beam;

c. a movable photoconductive member;

d. means for scanning said image modulated laser beam over said photoconductive member while said photoconductive member is moving to develop a latent electrophotographic image;

e. means for applying charged toner particles to said latent electrophotographic image on said photoconductive member while said photoconductive member is moving, for developing a toner image;

f. means for transferring said toner image from said photoconductive member to said print medium while said print medium is moving;

g. a high energy laser source for producing a laser beam;

h. first and second rotatable, mechanically interconnected, faceted scanning mirrors in which the facets of the first and second scanning mirrors are relatively angularly displaced, disposed in the path of said image modulated laser beam and in the path of said high energy laser beam, respectively, said image modulated laser beam and said high energy laser beam, reflected, respectively, from adjacent facets of said rotatable faceted scanning mirrors, for scanning said high energy laser beams synchronously with scanning of said image;

i. a fixed mirror disposed in the path of said high energy laser beam between said faceted scanning mirrors and said print medium for projecting said high energy laser beam onto said toner image on said print medium while said print medium is moving, for producing softened toner, and j. a pair of Opposed rollers for receiving said print medium therebetween for applying pressure to said softened toner against said print medium.

* * * * *